United States Patent [19]

Bracken

[11] Patent Number: 4,883,257

[45] Date of Patent: Nov. 28, 1989

[54] SECURITY FENCING

[76] Inventor: Brendan Bracken, 35 Oaklawn West, Leixlip, County Kildare, Ireland

[21] Appl. No.: 78,378

[22] Filed: Jul. 24, 1987

[30] Foreign Application Priority Data

Jul. 25, 1986 [IE] Ireland ..... 1968/86

[51] Int. Cl.[4] ..... E04H 17/10

[52] U.S. Cl. ..... 256/54; 256/48; 256/32

[58] Field of Search ..... 256/47, 33, 37, 54, 256/55, 56, 32, 35, 36, 45, 48, 49, DIG. 5, 1

[56] References Cited

U.S. PATENT DOCUMENTS

| | | | |
|---|---|---|---|
| 417,077 | 12/1889 | Osborn | 256/48 X |
| 638,821 | 12/1899 | Sylvester | 256/54 X |
| 890,468 | 6/1908 | Sutherland | 256/48 |
| 1,086,441 | 2/1914 | Colvin | 256/35 |
| 1,105,369 | 7/1914 | Muller | 256/37 X |
| 3,246,076 | 4/1966 | Stoneburner | 256/54 X |
| 3,415,491 | 12/1968 | Wilcox | 256/54 X |
| 3,604,686 | 9/1971 | Parisien | 256/32 |
| 4,492,364 | 1/1985 | Boyanton | 256/32 X |

FOREIGN PATENT DOCUMENTS

| | | | |
|---|---|---|---|
| 0603950 | 8/1978 | Switzerland | 256/49 |

*Primary Examiner*—Peter M. Cuomo

*Attorney, Agent, or Firm*—Christie, Parker & Hale

[57] ABSTRACT

Security fencing has a number of posts and steel mesh attached thereto. Each post comprises a fixed section and a movable section. The fixed section has a number of internal supports on which the steel mesh is located. The movable section is adapted to fit over the fixed section and is provided with a number of locking members which engage corresponding locking bars secured within the fixed section.

Nine different embodiments are disclosed, some of which may be used in high security applications and others in moderate to low security applications.

11 Claims, 25 Drawing Sheets

SECURITY FENCING

The present invention relates to security fencing and in particular to posts for security fencing.

BACKGROUND TO THE INVENTION

Security fencing generally comprises steel posts at regular intervals and steel meshing secured to the posts. The steel structures are generally galvanised and/or provided with a plastics coating. When erecting a security fence, the posts are first secured in the ground and the steel meshing is secured to the posts usually by bending and welding. However, in bending or welding the steel meshing to the posts, the plastic coating and/or galvanising is necessarily removed from the bending or welding region. In time, corrosion may occur at these regions.

A further problem is that intruders can interfere with the connections between the steel meshing and the posts and in that way create an opening in the fence.

The object of the invention is to alleviate the above disadvantages.

SUMMARY OF THE INVENTION

The present invention provides a post for security fencing, the post comprising a pair of longitudinal sections, the first longitudinal section being adapted to be fixed in the ground and having means for locating steel meshing thereto, the second longitudinal section being adapted to fit over the first longitudinal section with complementary engaging means being provided for securing the first and second longitudinal sections together.

Preferably, the complementary engaging means are located within the post when assembled.

BRIEF DESCRIPTION OF THE DRAWINGS

Advantageously, the means by which the steel meshing is located on the post are located within the post when assembled.

The invention will hereinafter be more particularly described with reference to the accompanying drawings which show by way of example only, a number of embodiments of a post for security fencing according to the invention.

In the drawings:

FIG. 1 is a side view of the first embodiment of post;

FIG. 2 is a plan view of the first embodiment of post along A—A of FIG. 1;

FIG. 3 is a side view of the complementary engaging members of the second embodiment of post;

FIG. 4 is an end view of these members; and

FIG. 5 is a plan view of the second embodiment of post;

FIG. 6 is a cross-sectional side view of the second embodiment of post.

FIGS. 7, 8 and 9 are respectively a side view, a plan view on 7A—7A′ and a cross-sectional plan view 7B—7B′ of the upper part of a third embodiment of a post according to the invention.

Figure 10:
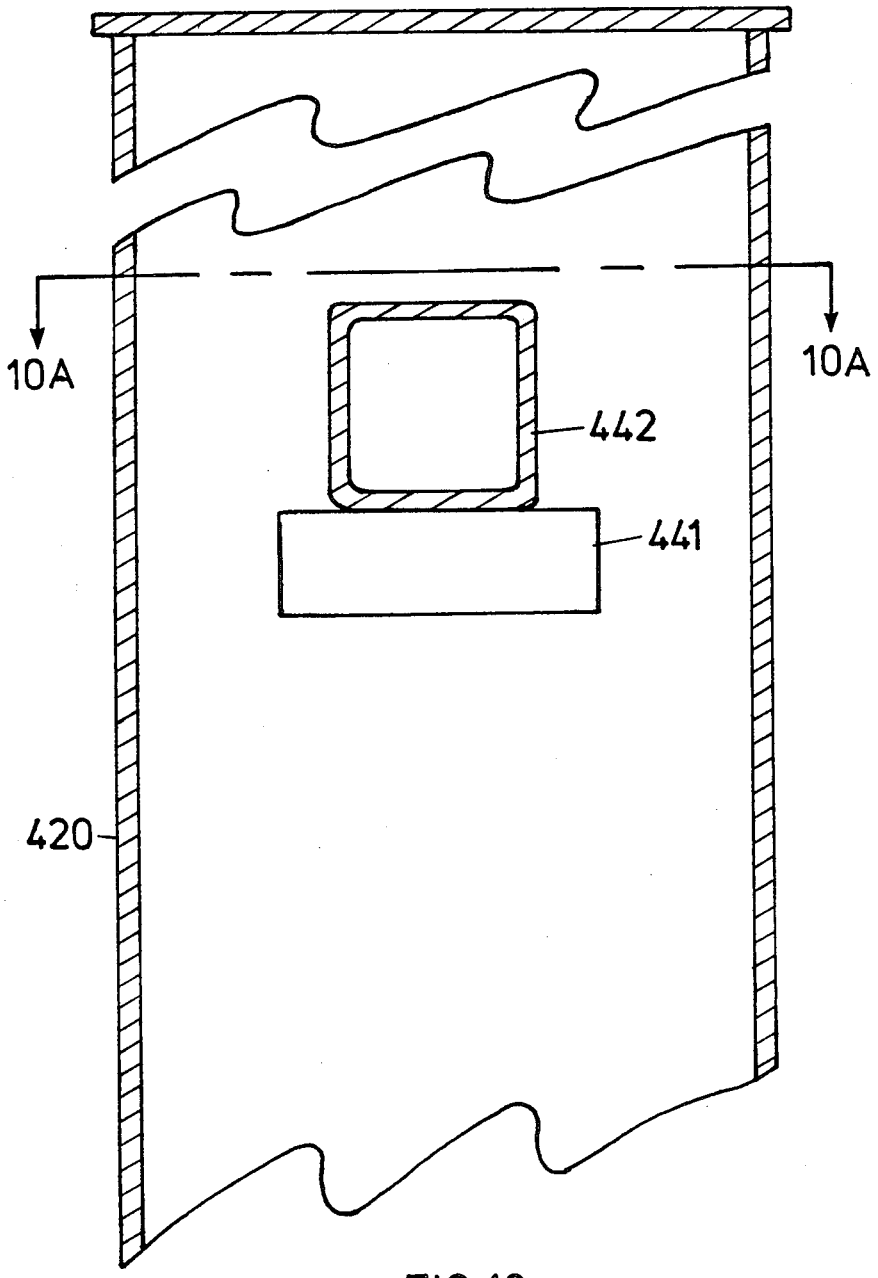
Figure 11:
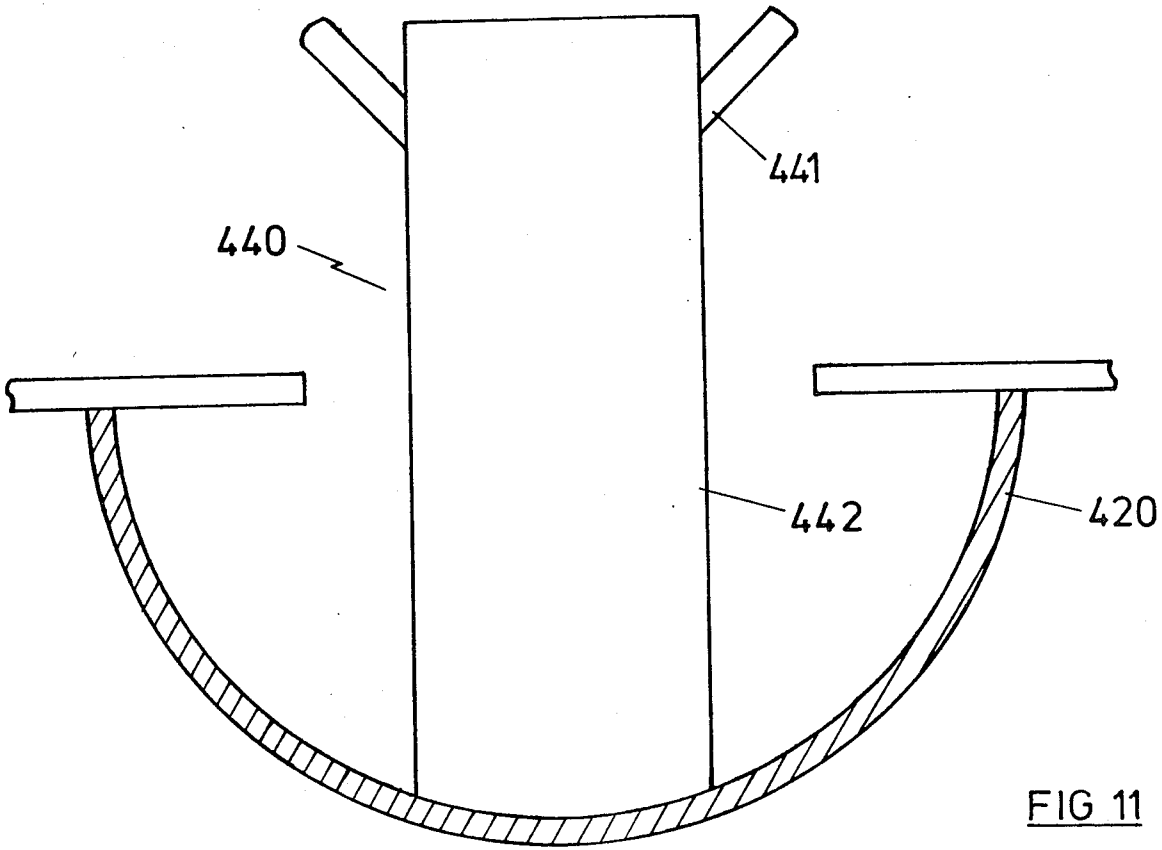
Figure 12:
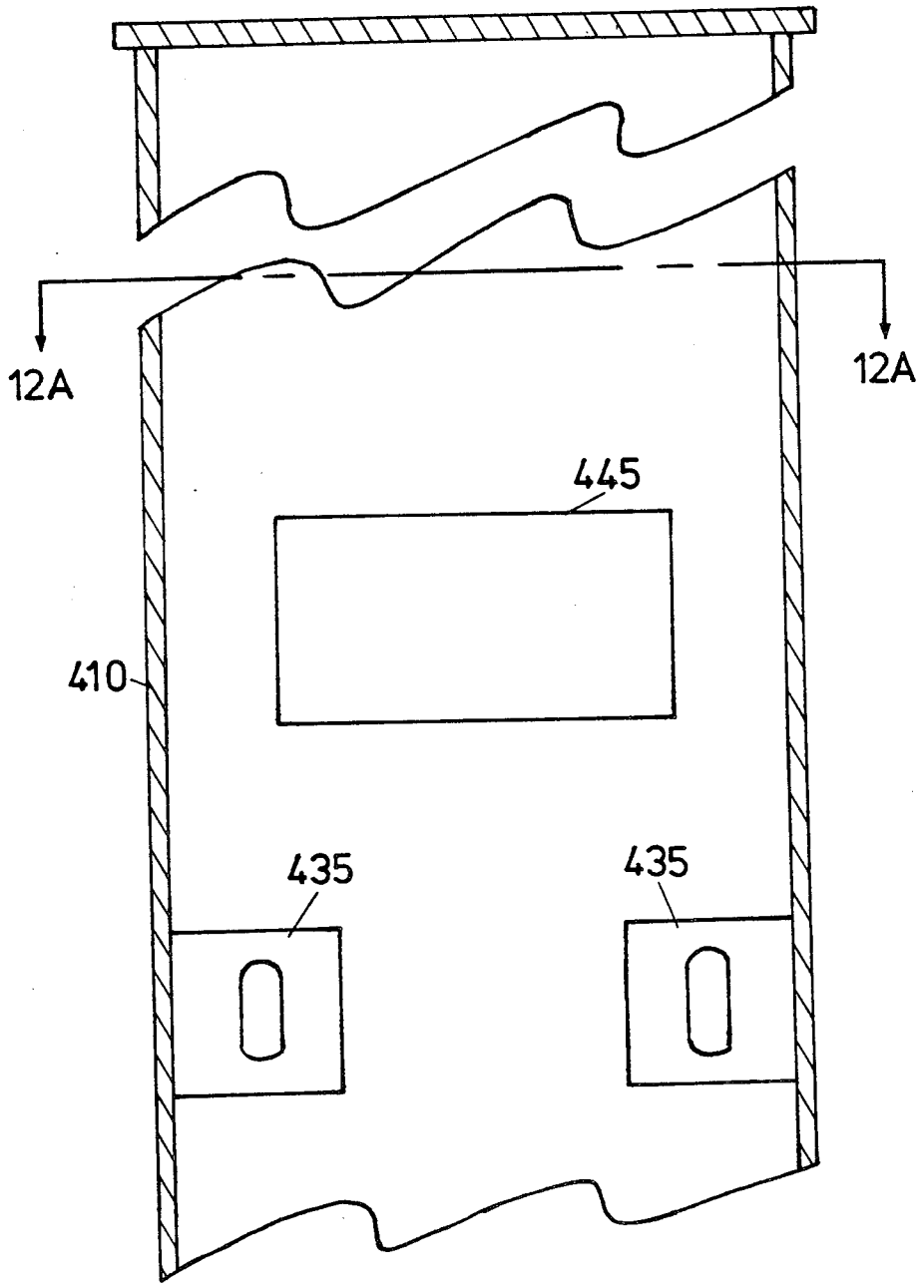
Figure 13:
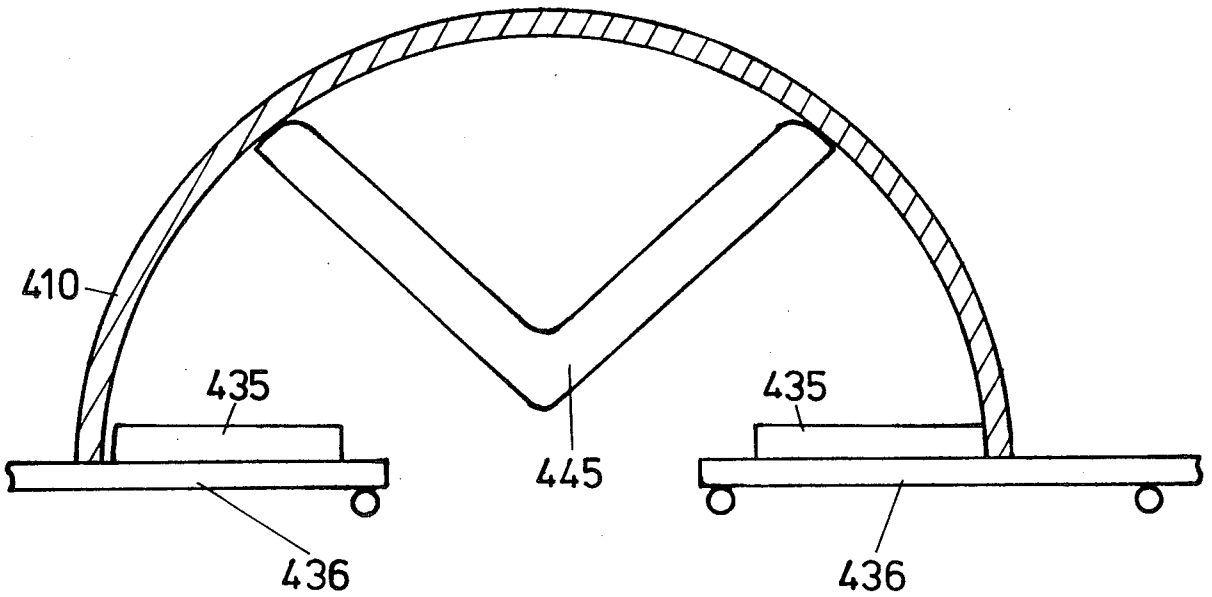
Figure 14:
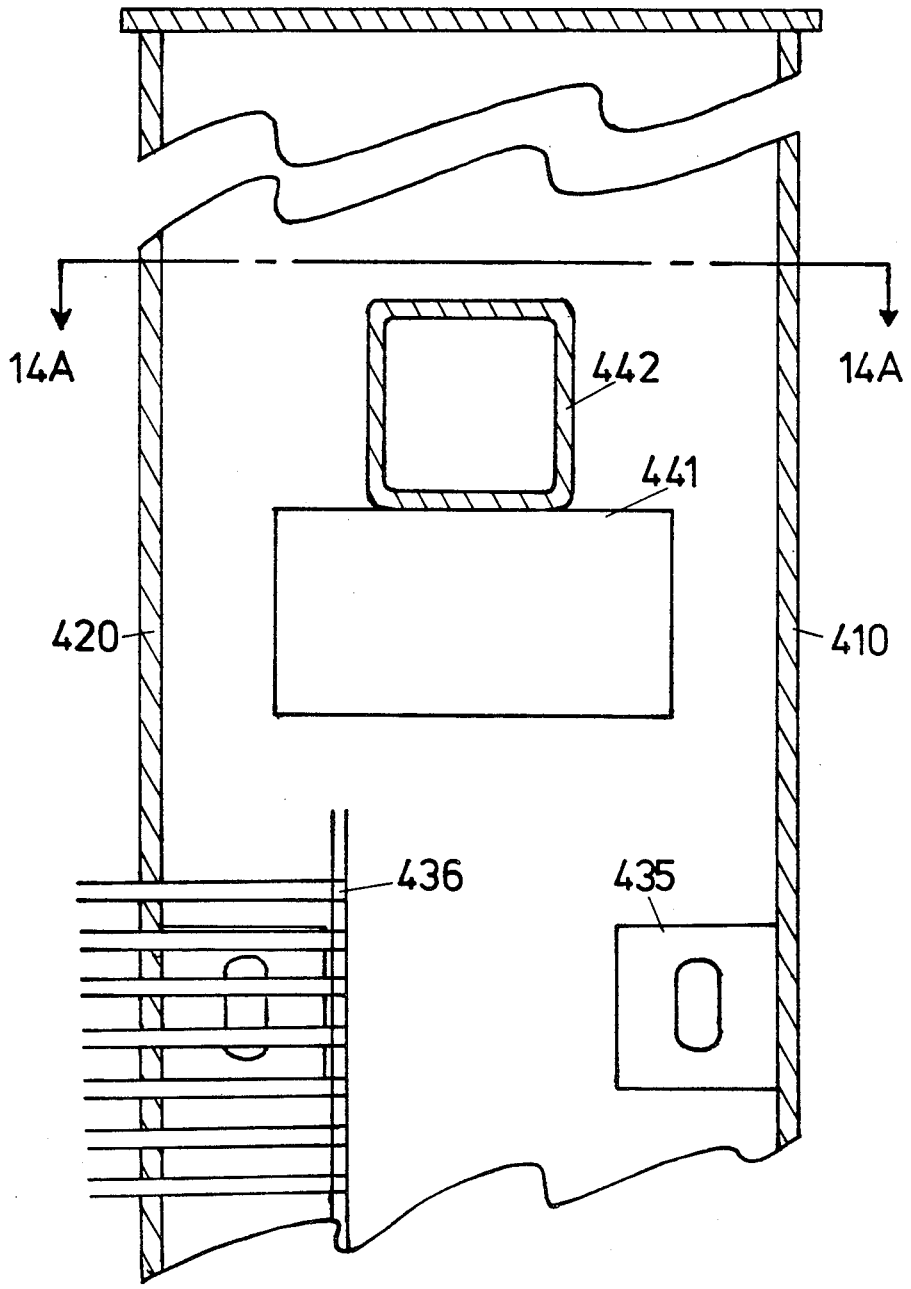
Figure 15:
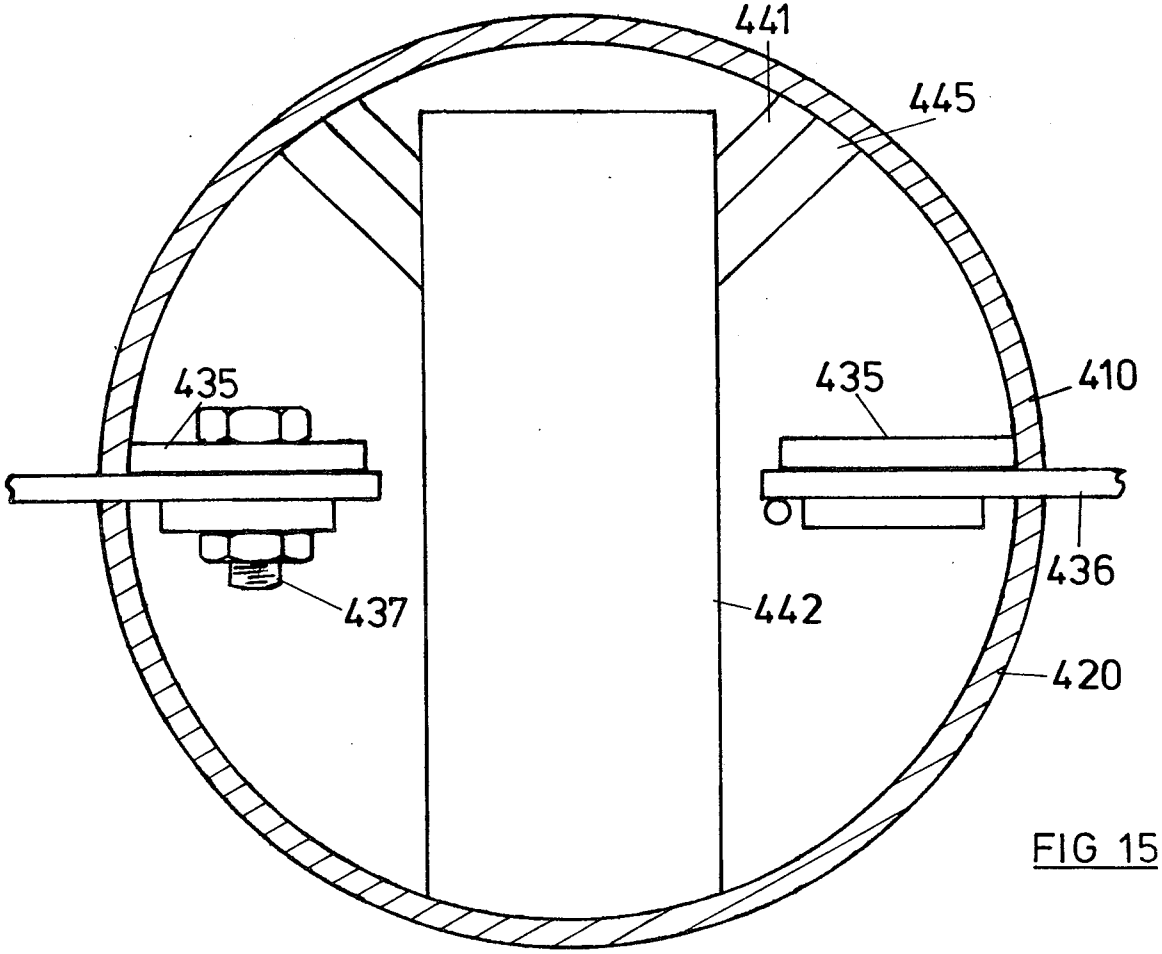
Figure 16:
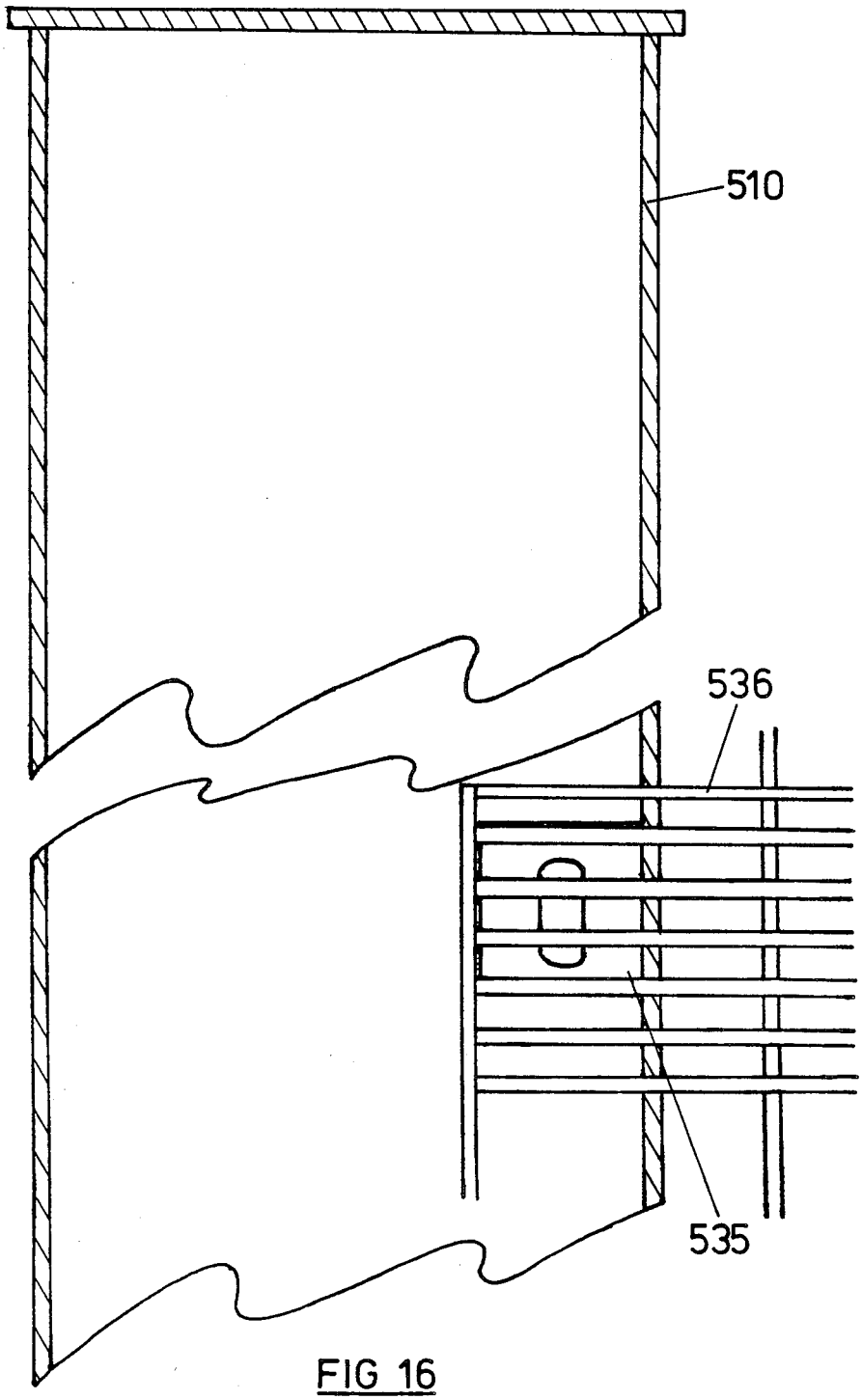
Figure 17:
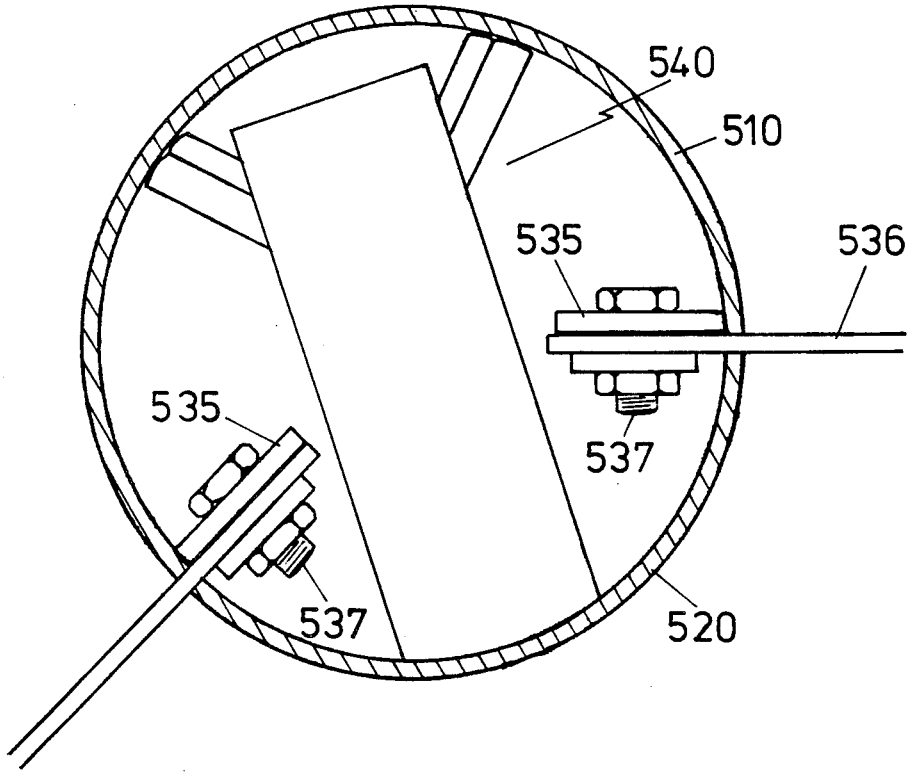
Figure 18:
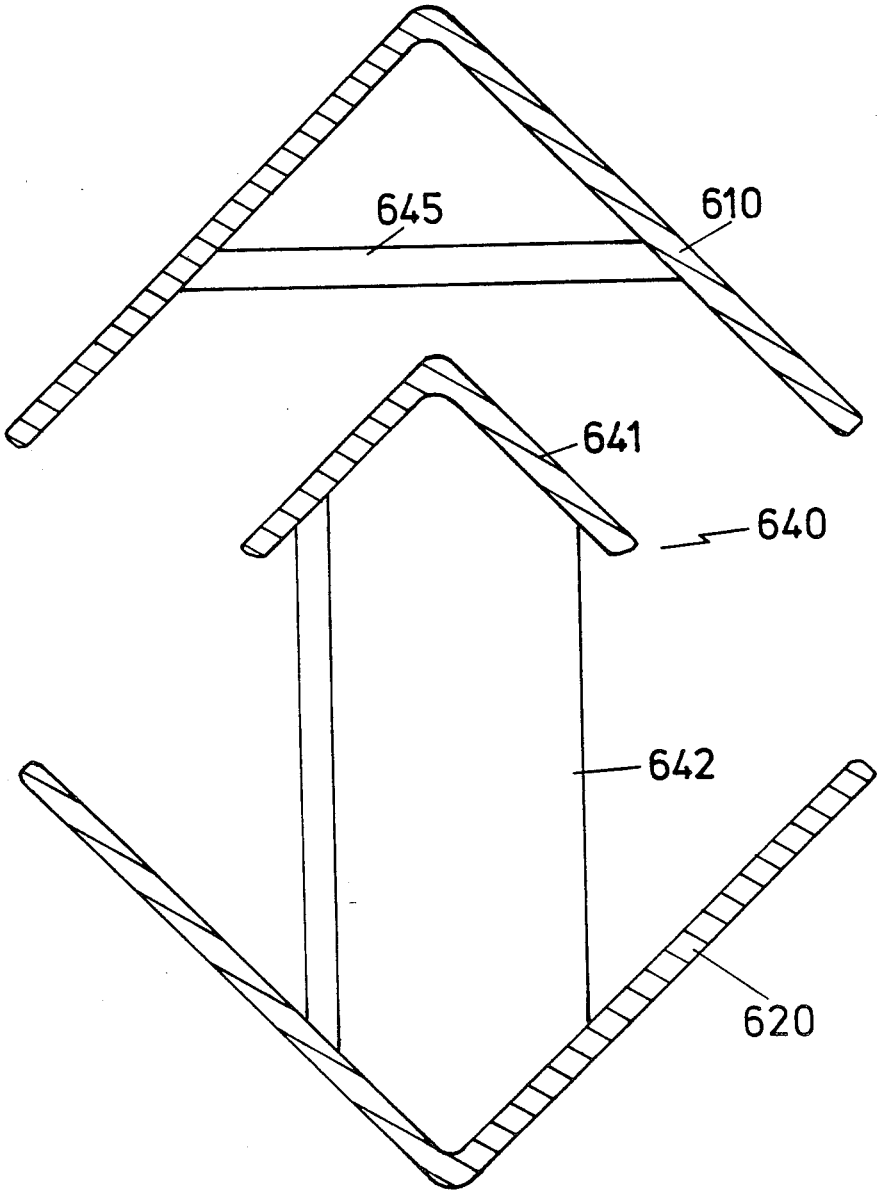
Figure 19:
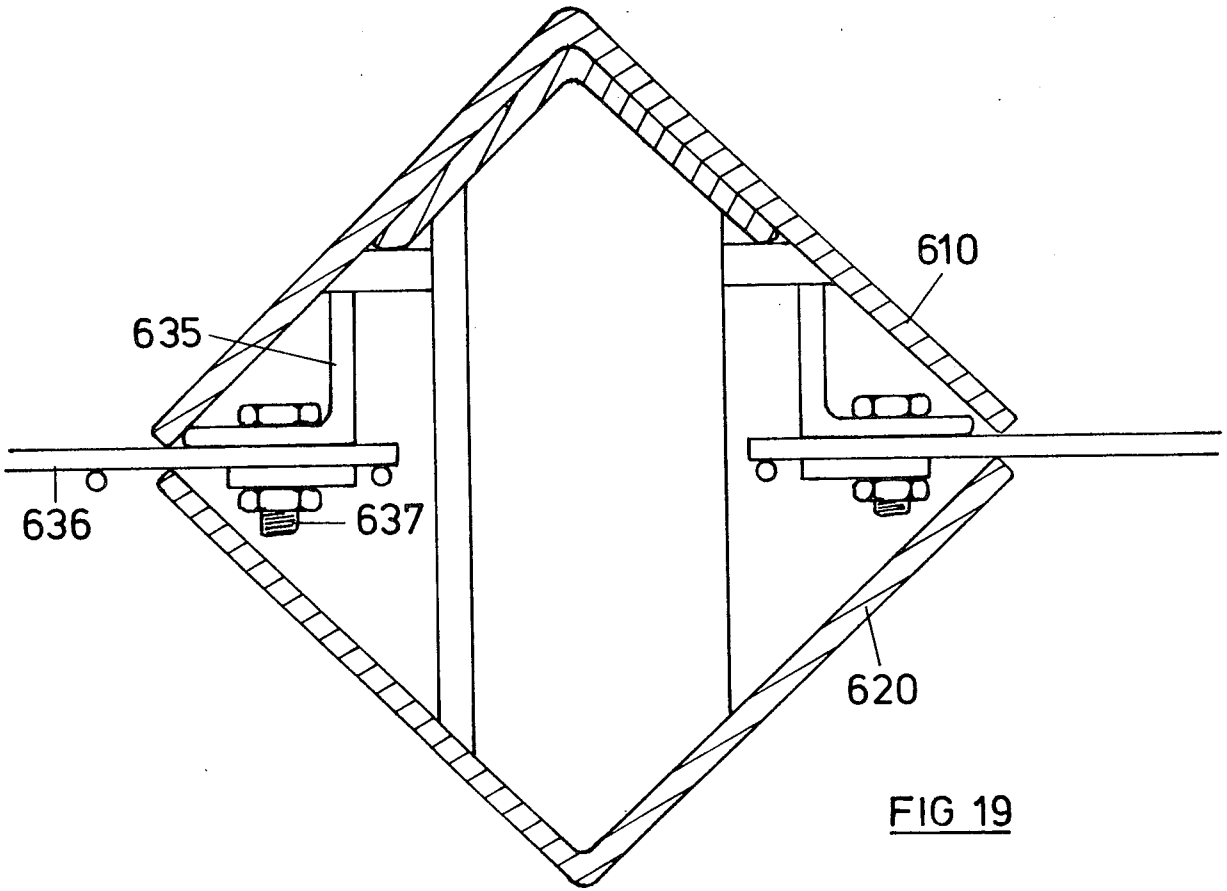
Figure 20:
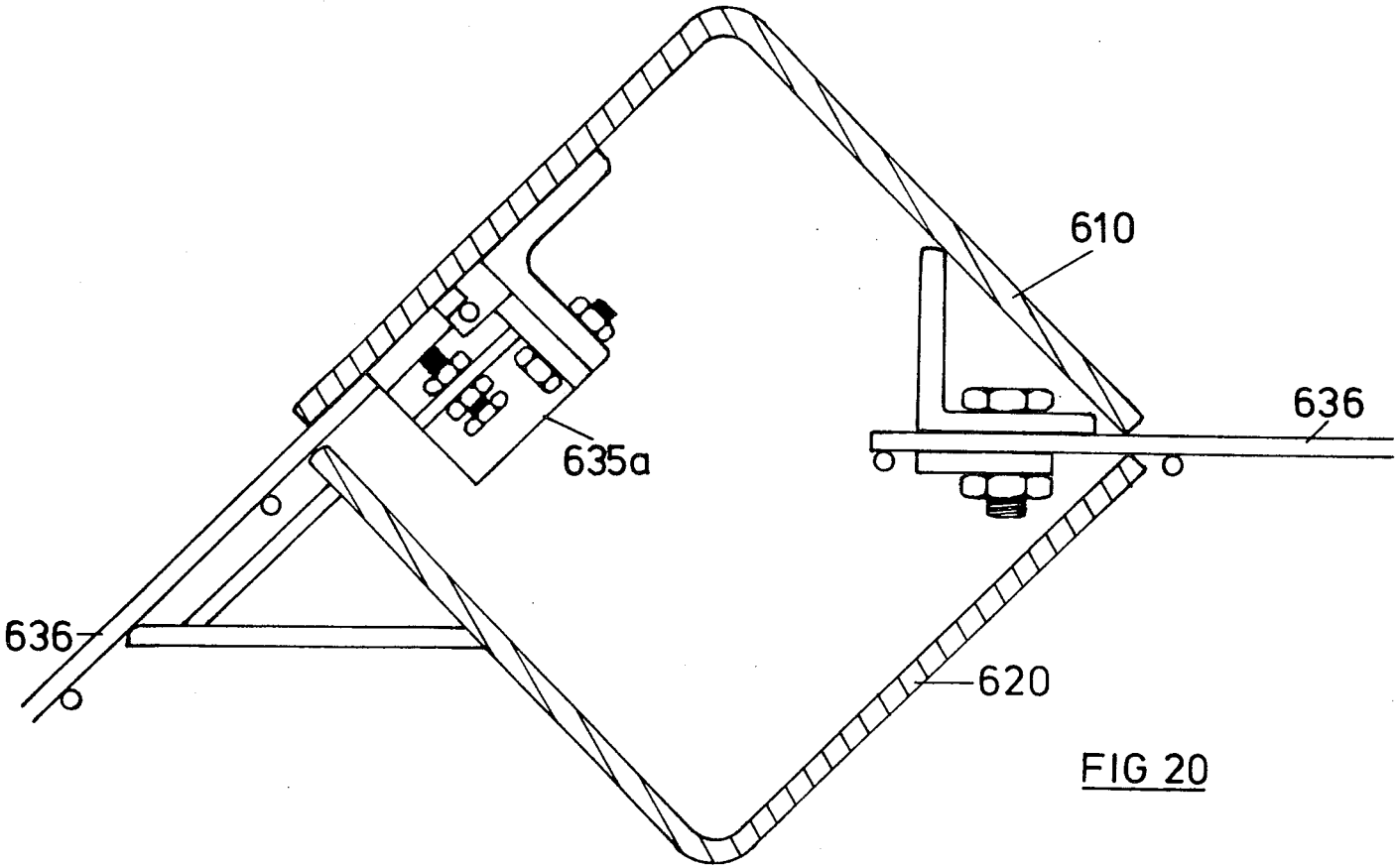
Figure 21A:
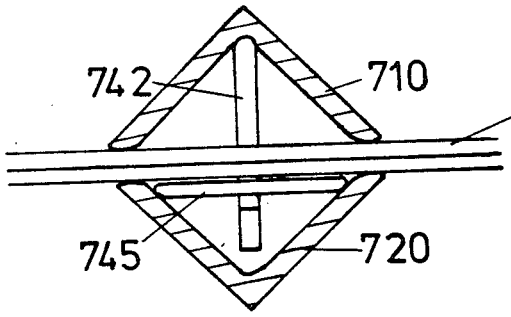
Figure 21:
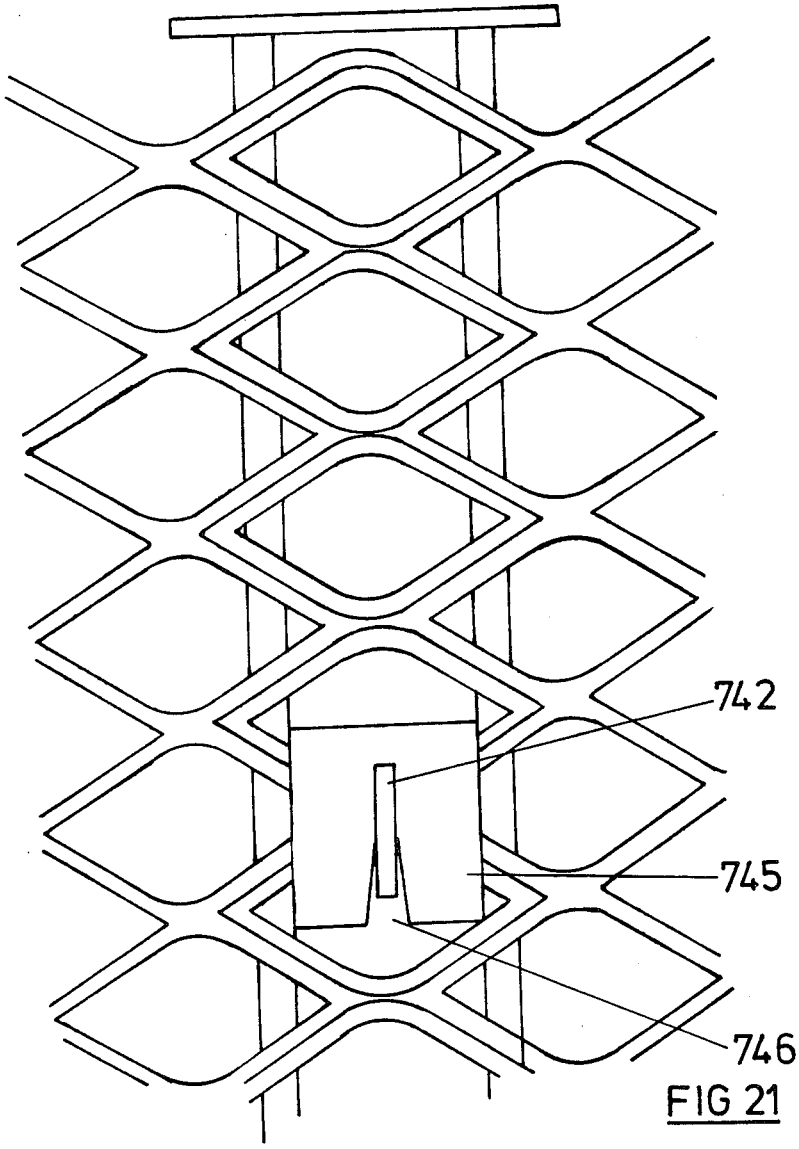
Figure 22A:
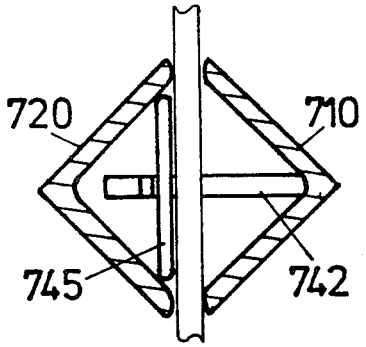
Figure 22:
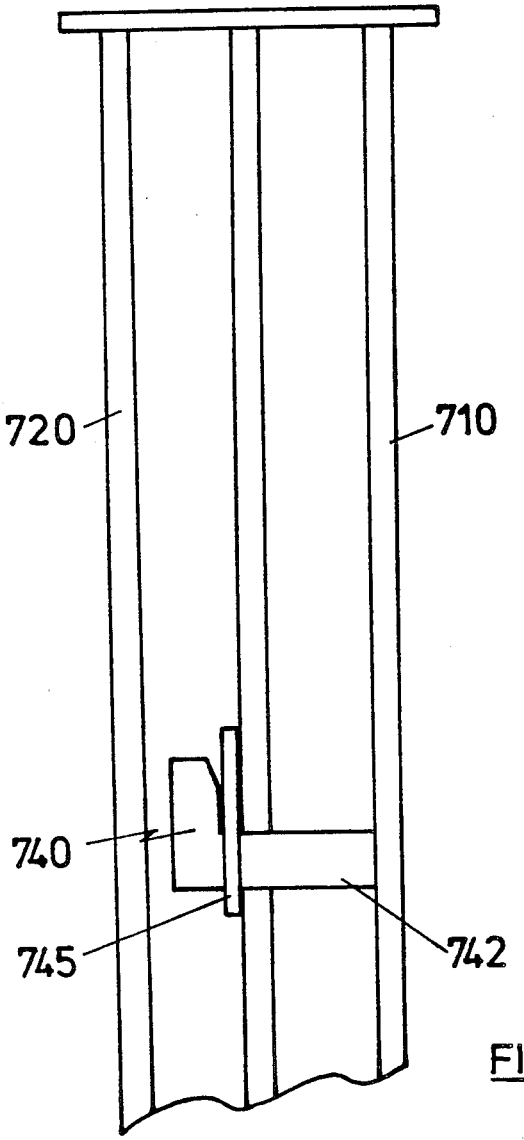
Figure 23A:
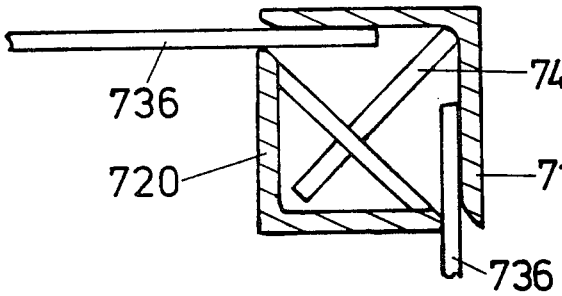
Figure 23:
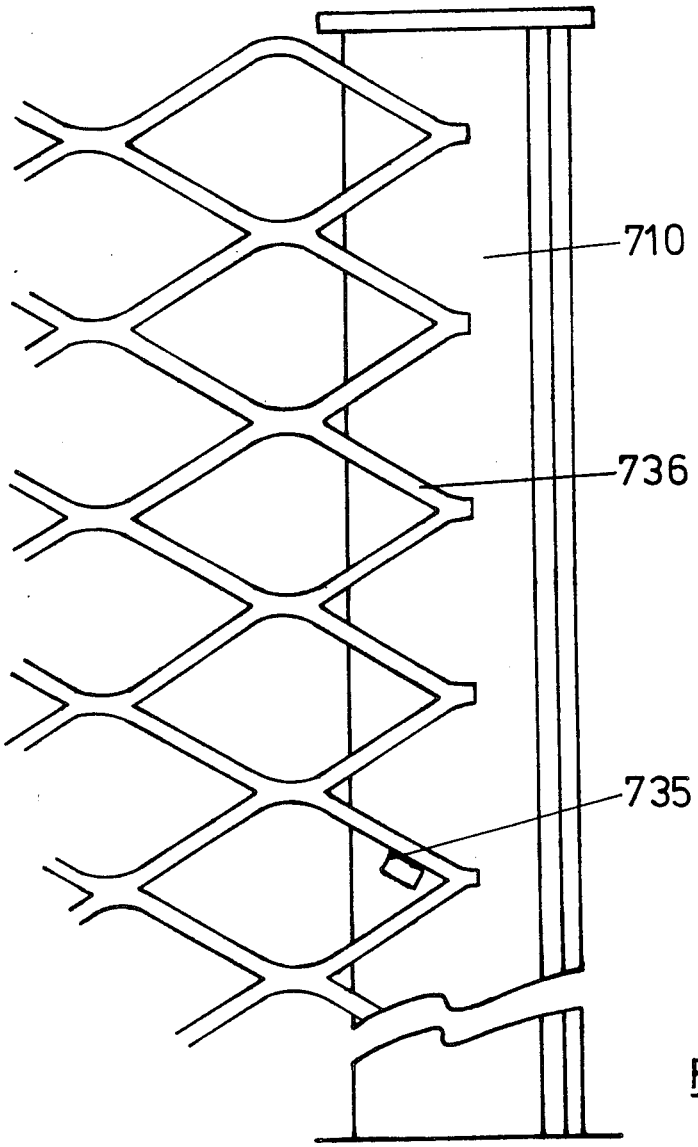

FIGS. 10 to 15 are views of a fourth embodiment of post according to the invention, FIGS. 10 and 11 being respectively a partial front view and a cross-sectional plan view on 10A—10A′ of the movable section of the post, FIGS. 12 and 13 being respectively a partial front view and a cross-sectional plan view on 12–12A′ of the fixed section of the post and FIGS. 14 and 15 being a partial front view and a cross-sectional plan view of the assembled post;

FIGS. 16 and 17 are respectively a partial front view of the fixed section of a fifth embodiment of the post and a cross-sectional plan view of the post;

FIGS. 18, 19 and 20 are three cross-sectional plan views of a sixth embodiment of post according to the invention;

FIGS. 21, 21*a*, 22, 22*a*, 23 and 23*a* illustrate the seventh embodiment of post according to the invention, FIGS. 21 and 21*a* being respectively a partially cut away front view and a plan view of the post with expanded metal mesh attached thereto, FIGS. 22 and 22*a* being respectively a cross-sectional side view and a plan view of the post only, and FIGS. 23 and 23*a* being respectively a partially cut away front view and a plan view of the seventh embodiment of post positioned at a right-angled corner.

Figure 24A:
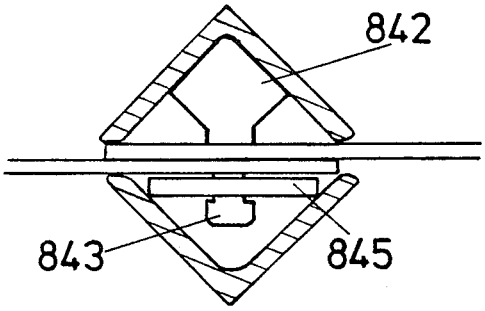
Figure 24:
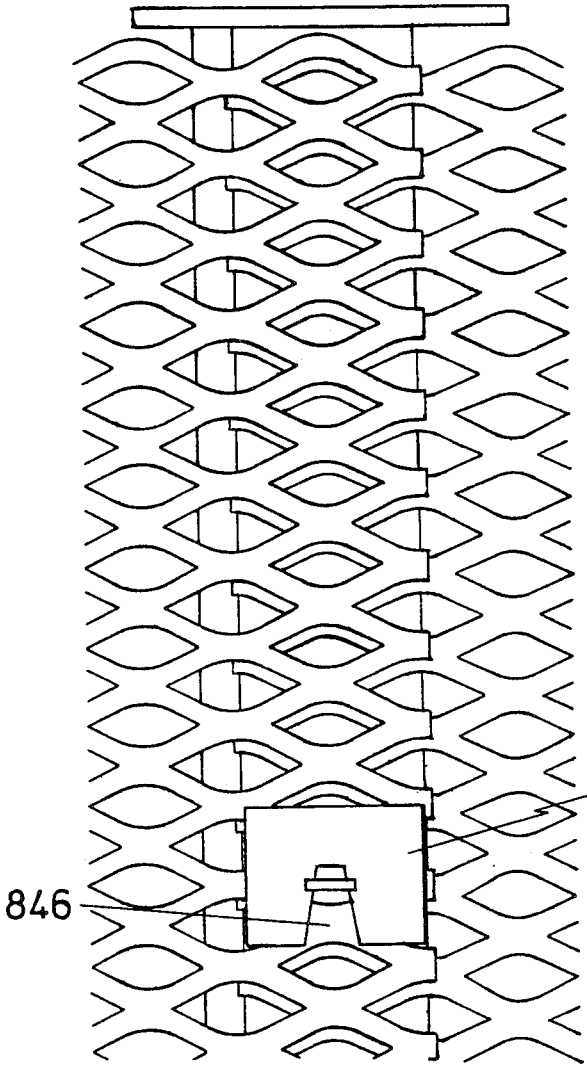
Figure 25A:
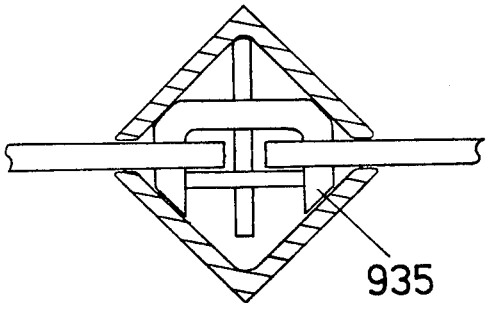
Figure 25:
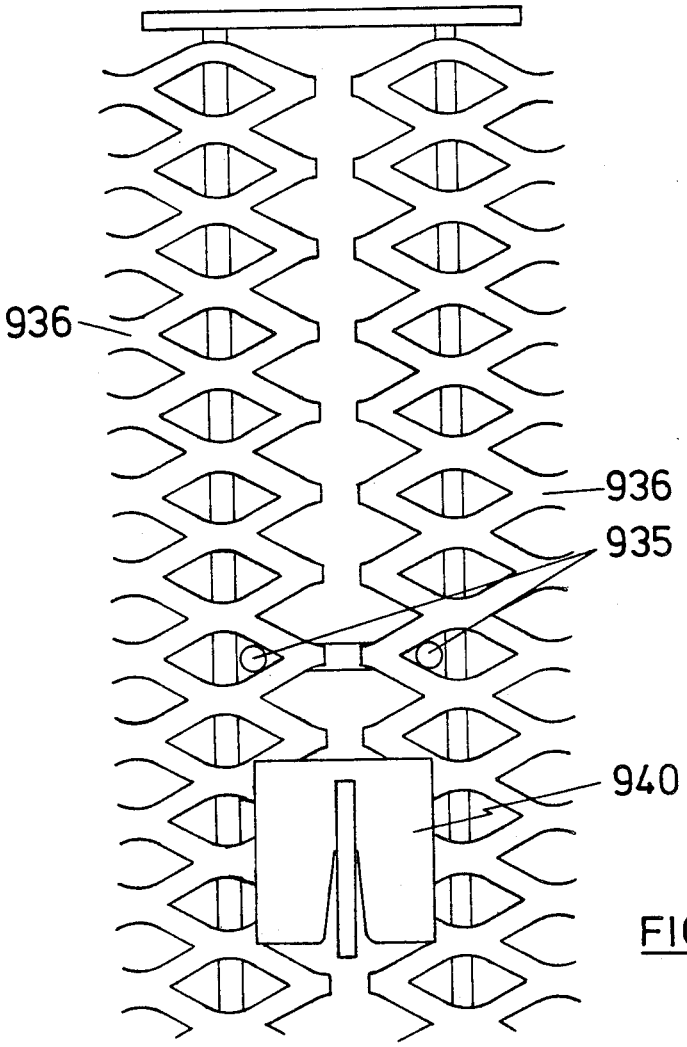
Figure 26A:
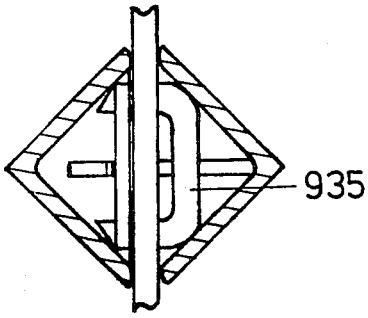
Figure 26:
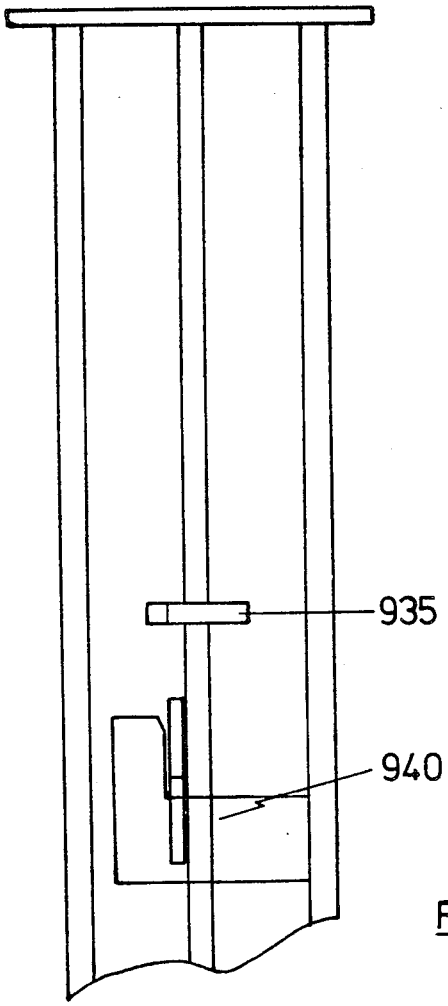

FIGS. 24 and 24*a* are respectively a partially cut away front view and a plan view of an eight embodiment of post according to the invention; and FIGS. 25, 25*a*, 26 and 26*a* are respectively a partially cut away front view, a plan view, a cross-sectional side view and a plan view of a ninth embodiment of post according to the invention.

DETAILED DESCRIPTION OF THE PREFERRED EMBODIMENTS

Figure 1:
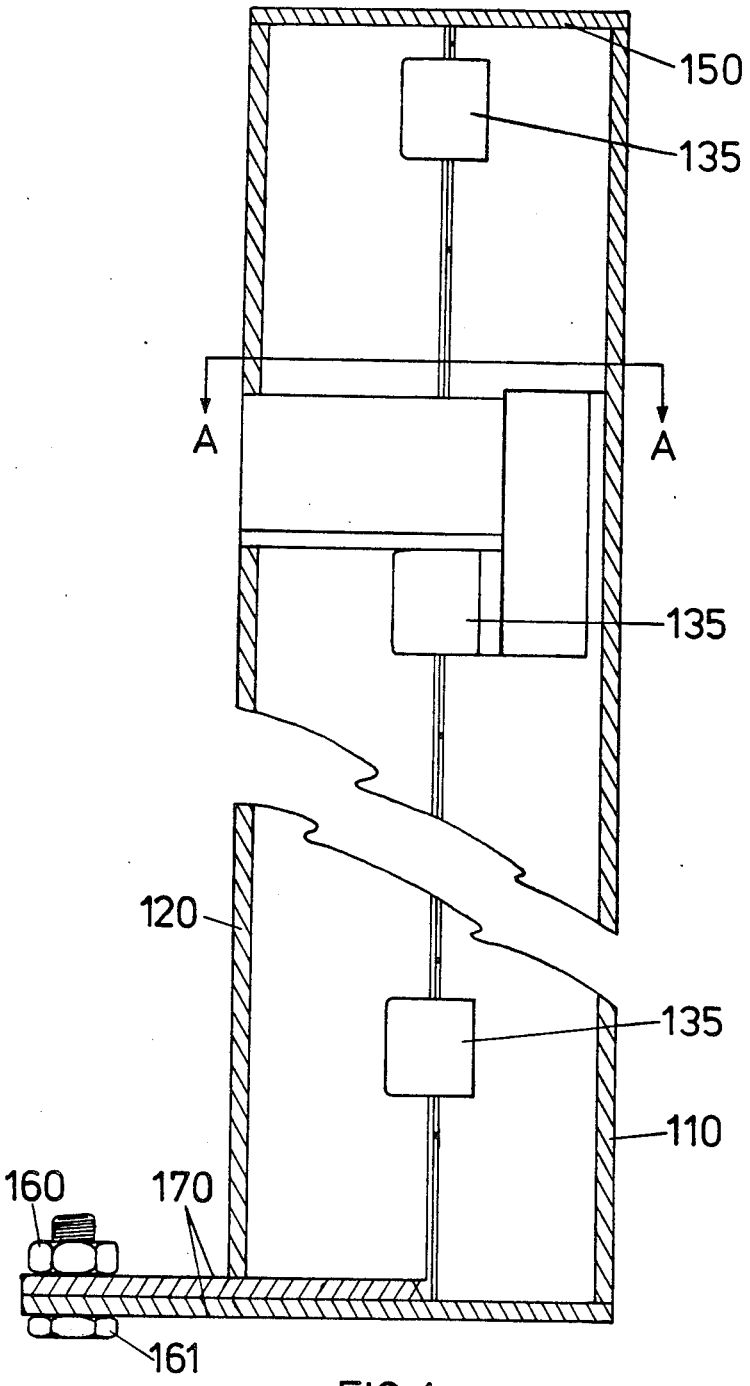
Figure 2:
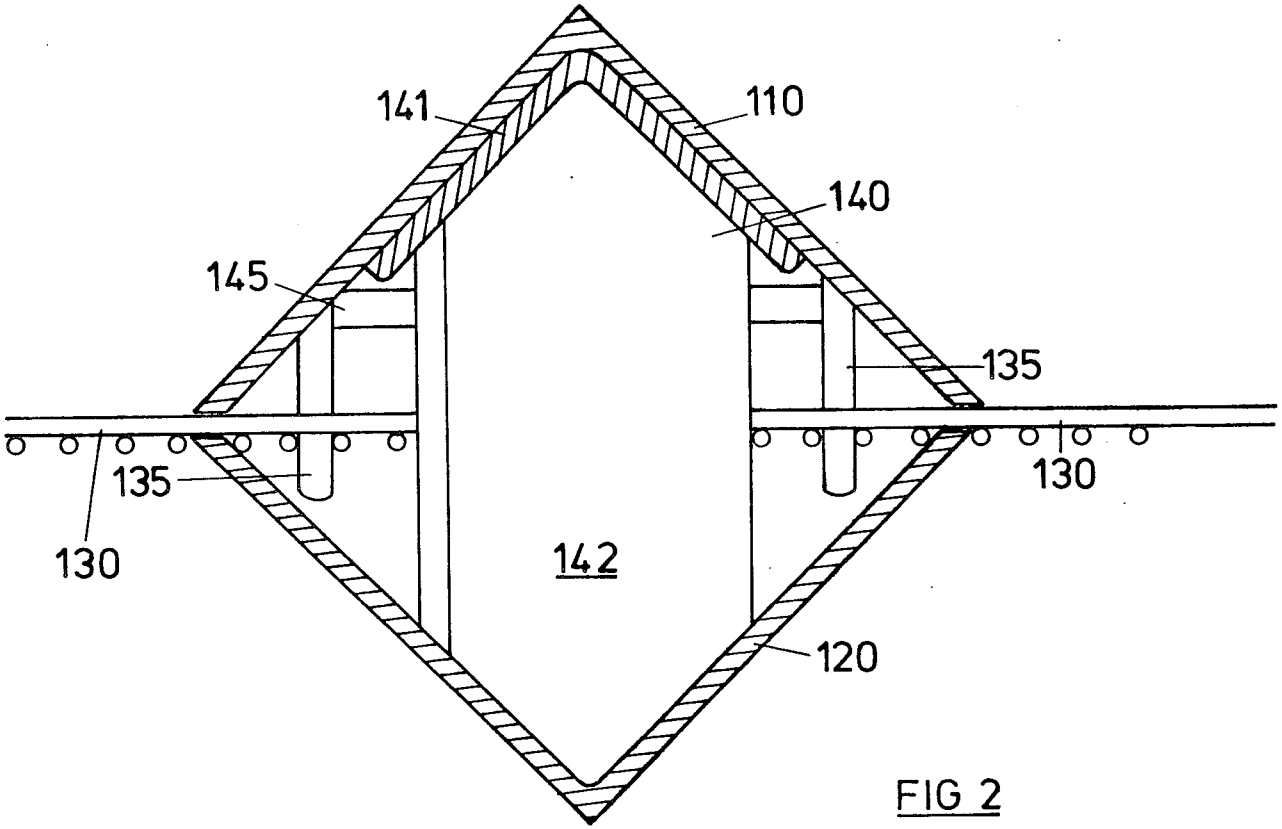
Figure 3:
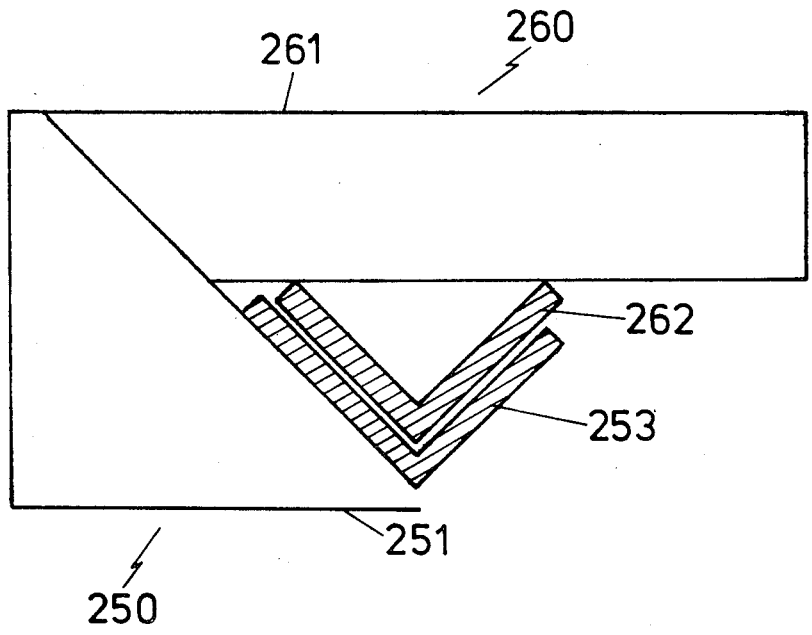
Figure 4:
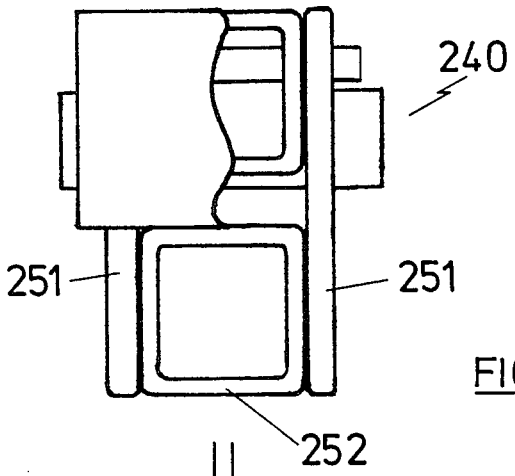
Figure 5:
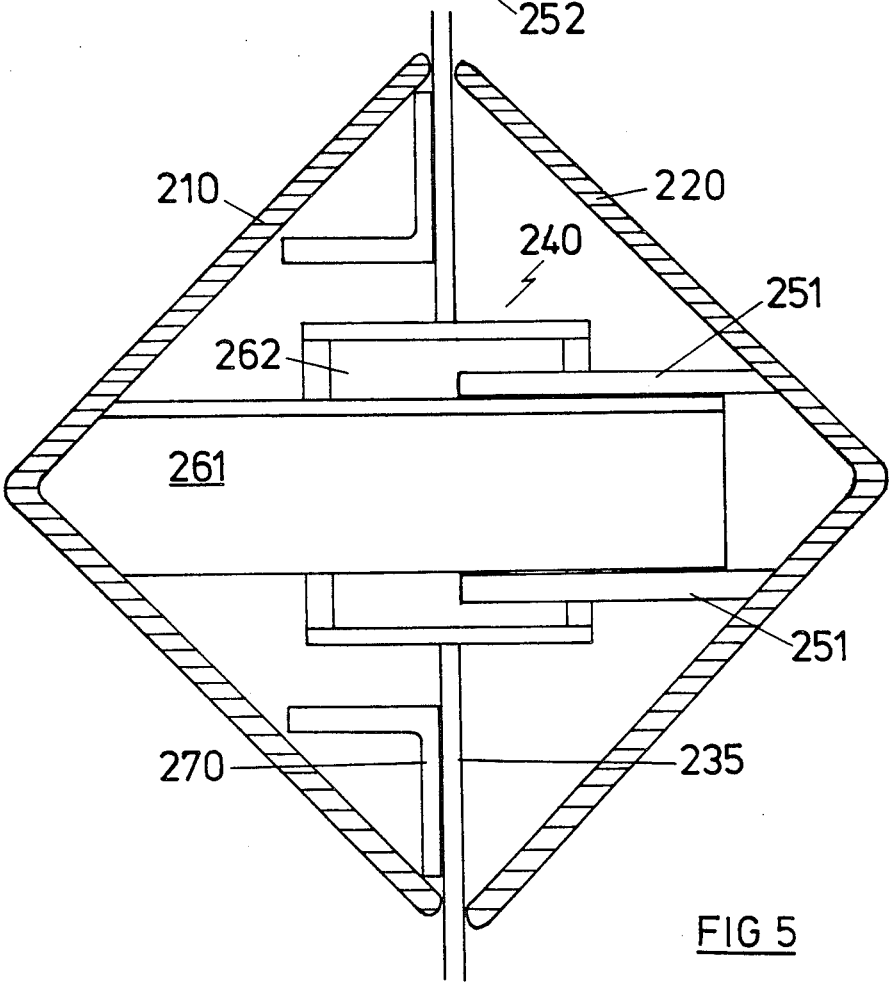
Figure 6:
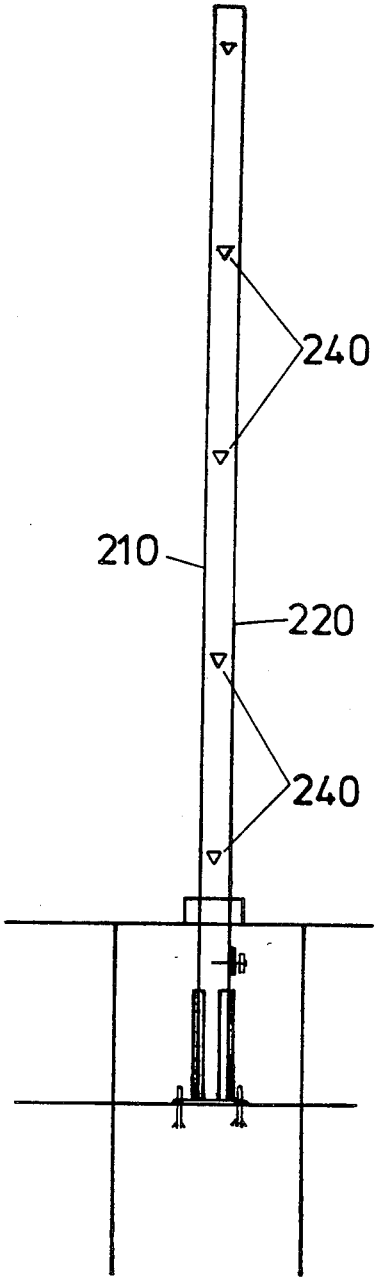

Referring to FIGS. 1 and 2 of the drawings, the post comprises a pair of longitudinal sections, a fixed section 110 and a movable section 120. When erecting a security fence, the section 110 is fixed in position in the ground and steel meshing 130 is located over supports 135. The movable section 120 covers the supports 135. The movable section 120 is provided with a number of members (only one of which 140 is shown). The member 140 engages with a bar 145 on the fixed section 110. The member 140 has an angled face 141 which engages against the inner face of the fixed section 110 and a strut 142 fixed to the movable section 120. The movable section 120 also is provided with a plate 150 which fits over the fixed section 110 when in position and acts as a cover for the post. A nut and bolt 160 and 161 secure the flanges 170 of the fixed section 110 and movable sections 120. The ends of the sections 110 and 120 are covered in concrete or the like to anchor the post and prevent access to the flanges 170.

Referring now to FIGS. 3, 4, 5 and 6 the second embodiment of post comprises a fixed section 210 and a movable section 220 which engages with the fixed section 210 by means of the members 240.

Each member 240 has two engaging parts, the part 250 secured to the fixed section 210 and the part 260 secured to the movable section 220. Part 250 includes a pair of gussett plates 251, a box section 252 and an angle plate 253. The part 210 includes a box section 261 and an angle plate 262 which is engageable with the angle plate 253 to engage the movable section 220 with the fixed section 210. The fixed section 210 also includes two right angled plates 270 to which the steel meshing 235 is bolted. The plates 270 are covered by the movable section 220.

Figure 7:
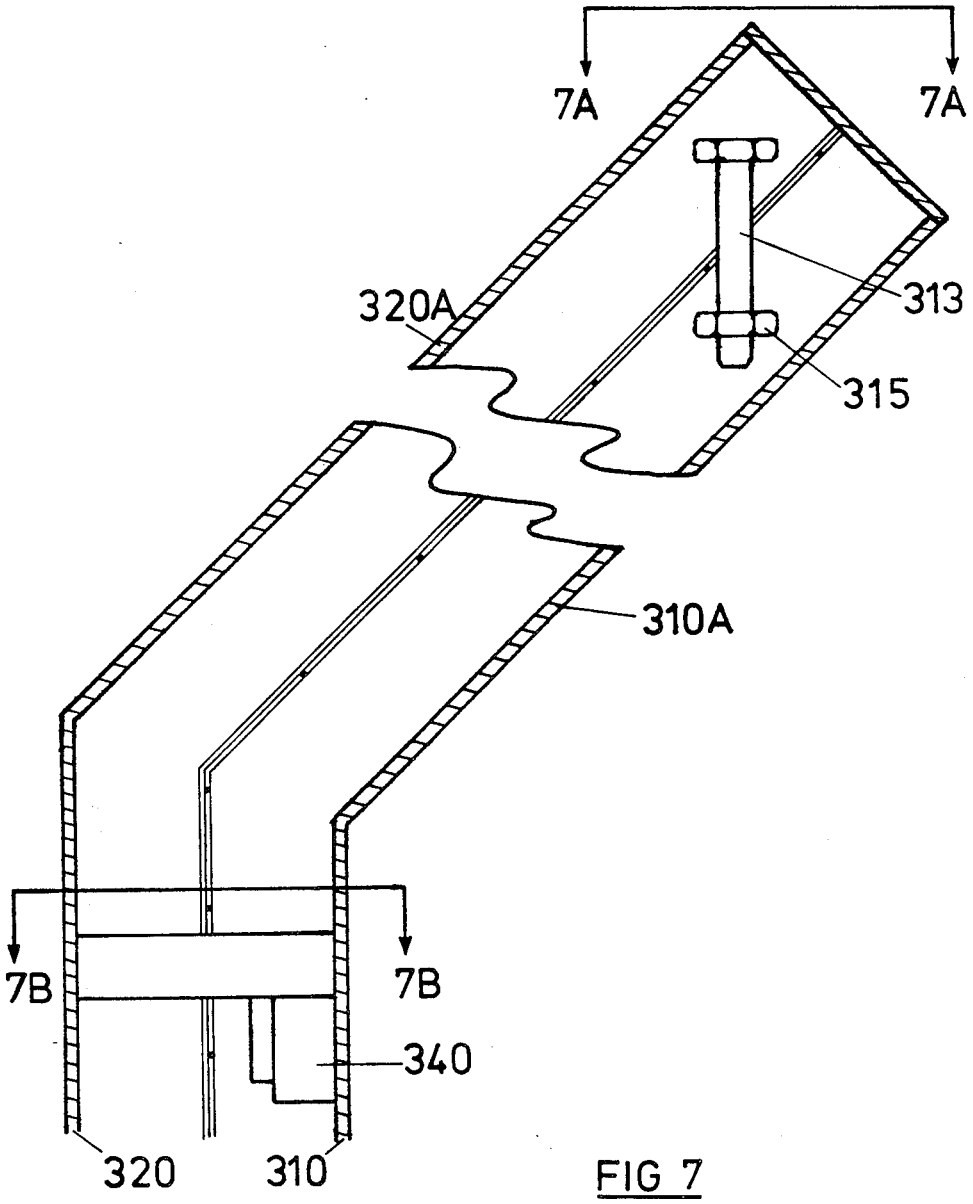
Figure 8:
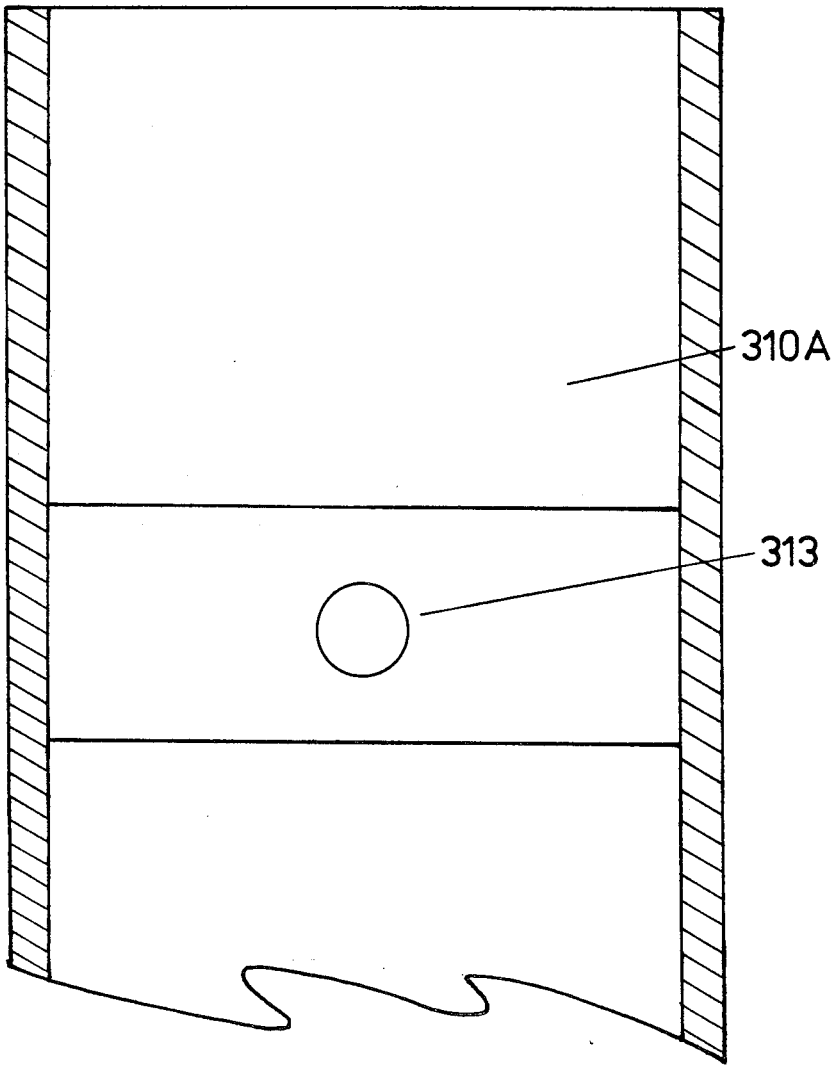
Figure 9:
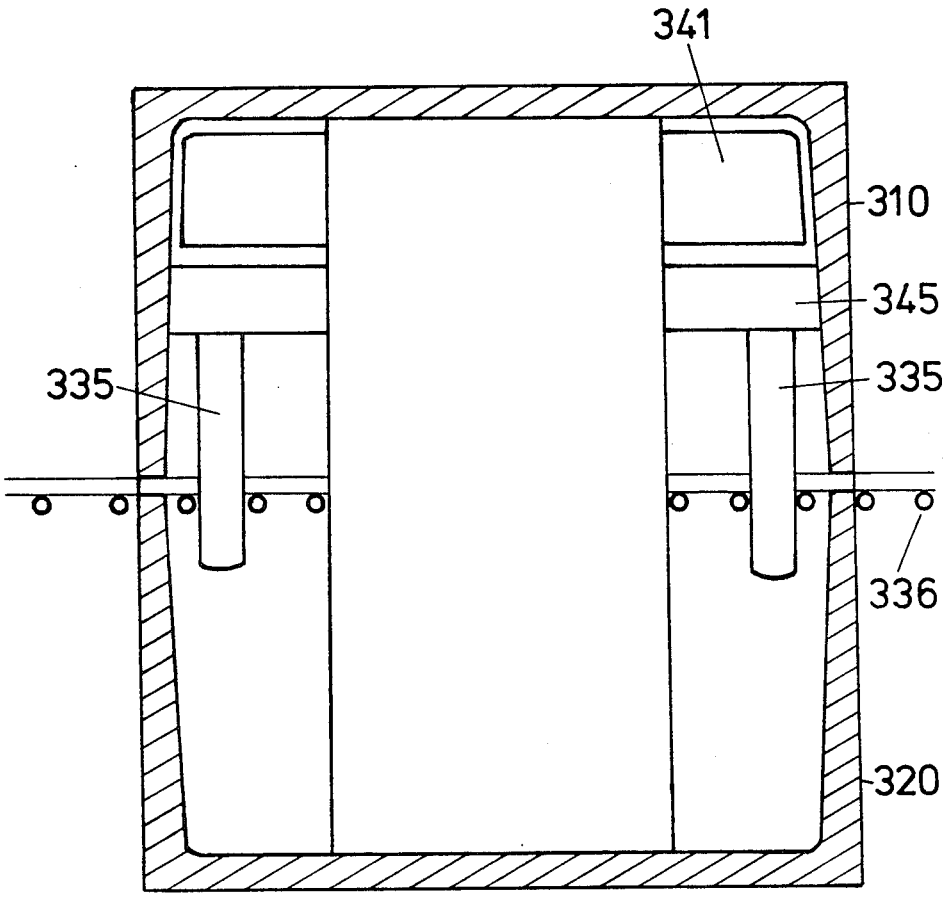

Referring to FIGS. 7, 8 and 9, the third embodiment comprises a fixed section 310 and a movable section 320 which engages with the fixed section 310 by means of members 340. The sections 310 and 320 also have inclined upper parts 310A and 320A which are secured together by a pin 313 and socket 35. FIG. 9 shows a pair of supports 335 which retain the wire mesh 336. The fixed section 310 is provided with a locking bar 345 which retains the locking element 341 of the movable section 320.

The fourth embodiment of post as shown in FIGS. 10 to 15 comprises a fixed section 410 and a movable section 420 which engages with the fixed section 410 by means of members 440 to provide a post of circular cross-section. Each member 440 comprises a strut 442 and a locking element 441 which engages with a locking plate 445 on the fixed section 410. Wire mesh 436 is bolted to retaining brackets 435 by bolts 437.

FIGS. 16 and 17 illustrate the fifth embodiment of post which is similar to the fourth embodiment except that the wire mesh 536 is fixed to the post at an included angle of 135 degrees. The fifth embodiment comprises a fixed section 510 and a movable section 520 which engages with the fixed section 510 by means of members 540. The wire mesh 536 is bolted to retaining brackets 535 by bolts 537.

The sixth embodiment of post will now be described with reference to FIGS. 18, 19 and 20 of the drawings and comprises a fixed section 610 and a movable section 620 which engages with the fixed section 610 by means of members 640. Each member 640 comprises a strut 642 and a locking element 641 which engages a locking bar 645 on the fixed section 610. Wire mesh 636 is retained in brackets 635 by bolts 637. Modified brackets **635*a* may be used to position the wire mesh 636 at an angle as shown in FIG. 20**.

FIGS. 21, **21*a*, 22, 22*a*, 23 and 23*a* illustrate the seventh embodiment of post according to the invention which comprises a fixed section 710 and a movable section 720 which engages with the fixed section 710 by means of members 740. Each member 740 comprises an L-shaped bracket 742 fixed to the inner corner of the fixed section 710 and a locking plate 745 fixed to the movable section 720. The locking plate 745 is provided with a slot 746 for engaging the L-shaped bracket 742. The L-shaped bracket 742 which has a horizontally extending spine and a vertically extending leg, is also used to support the expanded metal mesh 736. As shown in FIG. 21 the sheets of mesh 736 overlap at the post. FIGS. 23 and 23*a* show a modification of the seventh embodiment which makes it suitable for use at right angled corners. The two sheets of mesh 736 are located on the inner walls by lugs 735** (only one of which is shown).

The eight embodiment of post according to the invention is shown in FIGS. 24 and **24*a* and is essentially a modification of the seventh embodiment. The essential modification resides in the locking members 840, each of which comprises a bracket 842 having a narrow neck region 843 which engages a slot 846 in locking plate 845**.

A further modification of the seventh embodiment is shown in the drawings relating to the ninth embodiment. The locking member 940 is similar to the locking member 740, however, the sheets of mesh 936 do not overlap and are located within the post by pairs of retaining pins 935 (only one of which is shown).

Of the nine embodiments disclosed, some may be used in high security applications such as prisons and places of detentions. Other embodiments may be used in moderate to low security applications such as perimeter fencing and the like for factories and warehouses.

I claim:

1. A post for security fencing, the post comprising a pair of longitudinal sections, the first longitudinal section being adapted to be fixed in the ground and having means for securing fence meshing thereto, the second longitudinal section being adapted to fit over the first longitudinal section, with complementary engaging means being provided for securing the first and second longitudinal sections together, said complementary engaging means being enclosed within the post when assembled, the complementary engaging means comprising at least one generally L-shaped bracket and a complementary locking plate; such an L-shaped bracket having a spine and a leg generally perpendicularly disposed to the spine, the end of the spine remote from the leg being fixed to an inner wall of the first longitudinal section with the leg being vertically disposed on erection of the longitudinal sections, and such a corresponding locking plate having a slot at its lower edge and being fixed in the second longitudinal section so as to be engageable with the corresponding L-shaped bracket of the first longitudinal section.

2. A post for security fencing as claimed in claim 1 wherein the spine of the L-shaped bracket extends through the fence meshing and the locking plate fits between the leg of the L-shaped bracket and the fence meshing.

3. A post for security fencing as claimed in claim 1 wherein the means for securing the fence meshing to the post is enclosed within the post when assembled.

4. A post for security fencing as claimed in any of claims 3 or 1, in which the complementary engaging means comprises at least two co-operating elements, one element being fixed to the first longitudinal section the other element being fixed to the second longitudinal section.

5. A post for security fencing as claimed in claim 1 wherein the first longitudinal section and the second longitudinal section collectively form a hollow post when side-by-side, the complementary engaging means being engageable and disengageable upon vertical movement of the second longitudinal section relative to the first longitudinal section.

6. A post for security fencing as claimed in claim 5 wherein the means for securing fence meshing to the first longitudinal section is completely within the hollow post when the second longitudinal section is engaged.

7. A post for security fencing, the post comprising a pair of longitudinal sections, the first longitudinal section being adapted to be fixed in the ground and having means for securing fence meshing thereto, the second longitudinal section being adapted to fit over the first longitudinal section, with complementary engaging means being provided for securing the first and second longitudinal sections together, said complementary engaging means being enclosed within the post when assembled, the complementary engaging means comprising at least one bracket having a generally upwardly extending leg, and a complementary locking plate; such a bracket being fixed to an inner wall of the first longitudinal section with the leg being vertically disposed on erection of the longitudinal sections, and such a corresponding locking plate having a slot at its lower edge and being fixed in the second longitudinal section so as to be engageable with the leg of the bracket of the first longitudinal section.

8. A post for security fencing as claimed in claim 7 wherein a portion of the bracket extends through the fence meshing and the locking plate fits between the leg of the bracket and the fence meshing.

9. A post for security fencing as claimed in claim 7 wherein the first longitudinal section and the second longitudinal section collectively form a hollow post when side-by-side, the complementary engaging means being engageable and disengageable upon vertical movement of the second longitudinal section relative to the first longitudinal section.

10. A post for security fencing as claimed in claim 9 wherein the means for securing fence meshing to the first longitudinal section is completely within the hollow post when the second longitudinal section is engaged.

11. A post for security fencing as claimed in claim 7 wherein the means for securing the fence meshing to the post is enclosed within the post when assembled.

* * * * *